United States Patent [19]

Lewis

[11] 4,162,770

[45] Jul. 31, 1979

[54] TOOTH BREAKER MEMBERS

[75] Inventor: Herbert H. Lewis, Ponte Vedra Beach, Fla.

[73] Assignee: Montgomery Industries International, Inc., Jacksonville, Fla.

[21] Appl. No.: 859,147

[22] Filed: Dec. 9, 1977

[51] Int. Cl.[2] ..... B02C 13/06; B02C 13/28

[52] U.S. Cl. ..... 241/191; 241/197; 241/294; 407/49

[58] Field of Search ..... 241/190, 191, 197, 294, 241/300; 407/46–49, 51, 56

[56] References Cited

U.S. PATENT DOCUMENTS

| | | | |
|---|---|---|---|
| 3,030,841 | 4/1962 | Haas | 407/47 X |
| 3,242,553 | 3/1966 | Bogsten | 407/49 X |
| 3,473,742 | 10/1969 | Montgomery | 241/190 X |
| 3,642,214 | 2/1972 | Blackwell | 241/197 X |

*Primary Examiner*—Howard N. Goldberg

*Attorney, Agent, or Firm*—Strauch, Nolan, Neale, Nies & Kurz

[57] ABSTRACT

A breaker tooth member for apparatus for the reduction of solid material such as wood, plastics, metal and the like comprises a metal head having an integral projecting mounting shank having an enlarged portion adjacent the head adapted to fit snugly in an enlarged mounting bore portion of a support ring, the head being formed opposite the shank with a recess having a flat back face intersecting a ledge defining a locking formation, and an integral harder wear resistant metal sharp edged element is mounted in the recess flush against the back face, that element being correspondingly formed along one edge to interlock with said ledge, and the element is fixed on the head by a plurality of pins having tight friction fit in aligned bores in the head and the element.

4 Claims, 11 Drawing Figures

TOOTH BREAKER MEMBERS

This invention relates to apparatus for the reduction of substantially any solid materials to smaller pieces for further processing, handling or disposal, and is particularly directed to special cutting or punching tooth members for such apparatus.

These members which will be referred to herein generally as breaker tooth members are of a special novel construction that provides for mounting a very hard working edge element on the breaker tooth member by means that firmly holds the element in position while working, as while reducing bodies of wood, plastics or metal, but enables fast and efficient replacement of worn or damaged elements with a minimum of down time for the apparatus, and this is the primary object of the invention.

A more specific object of the invention to provide a novel breaker tooth member wherein the working edge is a hard metal element seated and interlocked in a recess in the head of the breaker tooth member and held in place during material cutting by an accessible force fit pin arrangement.

Further objects of this invention will become apparent from the following detailed description, discussion and the appended claims taken in conjunction with the accompanying drawings.

PRIOR ART

Figure 1:
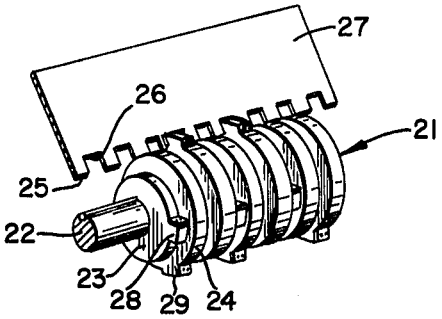
FIG. 1 is a generally perspective view illustrating a cooperating rotor and anvil arrangement in apparatus incorporating the invention.
Figure 2:
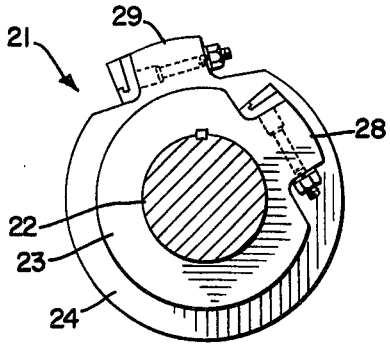
FIG. 2 is an end view partly in section showing the relative arrangements of the breaker tooth members on the rotor of FIG. 1.

FIGS. 1 and 2 essentially show a preferred arrangement and mounting of breaker tooth members in wood and like material reducing apparatus of the prior art.

A rotor 21 comprises a shaft 22 that has fixed thereon alternate small and large diameter rings 23 and 24 that are disposed opposite the edges 25 and 26 respectively of a fixed anvil 27. As shown in FIG. 2, the small rings 23 each are formed with an enlarged peripheral extension 28 that serves as a breaker tooth member support as will appear. Similarly each large ring 24 is formed with an enlarged peripheral extension 29 that serves as breaker tooth member support as will appear. The adjacent rings are angularly displaced for sequential action of the breaker teeth on the large and small rings during rotation of the rotor.

The foregoing arrangement is preferably that known in the prior art, and reference is made to U.S. Nos. 2,869,793 and 3,473,742, which use breaker tooth members different from those of the invention, for any further disclosure necessary to understand the rotor and anvil arrangements and operation.

PREFERRED EMBODIMENTS

Figure 3:
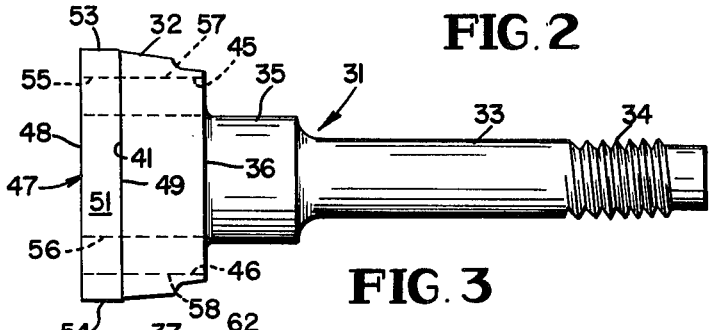
FIG. 3 is a top plan view of a breaker tooth member apart from the rotor.
Figure 4:
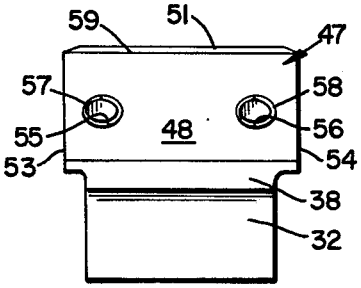
FIG. 4 is a front end view of the breaker tooth member of FIG. 3.
Figure 5:
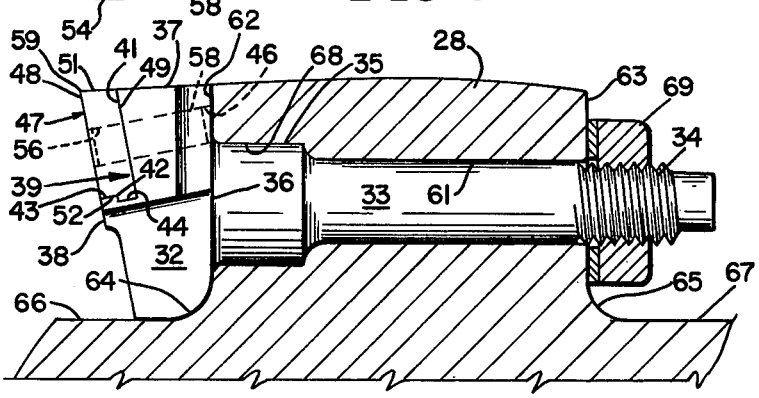
FIG. 5 is a side elevation partly broken away and in section showing the mounting of the working edge element on the head of the breaker tooth member of FIG. 3.

A first embodiment of breaker tooth member 31 is shown in FIGS. 3–5. This member comprises an enlarged head 32 integral with cylindrical shank 33 having a threaded end 34. The shank is of enlarged diameter and coaxially cylindrical for a short length immediately adjacent head 32 as shown at 35.

The rear surface 36 of head 32 is flat and perpendicular to the axis of shank 33. The top surface 37 (FIG. 5) of the head is preferably flat and may diverge front to rear at a small angle to the shank axis to intersect surface 36. The head has a flat front surface 38 inclined at an angle to surface 36 and diverging downwardly with respect thereto.

A recess 39 is formed in the flat forward surface 38 of the head. This recess extends the width of the head so as to be open at both sides of the head, and provides a flat back-up face 41 parallel to surface 38 and a flat stepped ledge 42 that is perpendicular to the surface 38. Ledge 42 comprises a forward portion lip 43 and a lower level parallel downwardly displaced rear portion 44 that intersects face 41 at right angles. The stepped ledge in effect provides an undercut to surface 38 and essentially is an extension of recess 39.

Two parallel uniform diameter smooth bores 45 and 46 are formed in head 34. As shown in FIGS. 3 and 5 these bores are on opposite sides of the axis of shank 33 and are similarly inclined to diverge downwardly relative to that axis and intersect face 41 at right angles. The rear ends of bores 45 and 46 open through rear surface 36 of the head.

An integral sharp edged hard metal element 47 is mounted in recess 39. Element 47 is flat with parallel forward and rear surfaces 48 and 49, a flat top surface 51, a stepped bottom surface 52 and flat side surfaces 53 and 54. The bottom of element 47 fits snugly into the stepped ledge 42, rear surface 49 is flush with head face 41, forward surface 48 is effectively a continuation of head surface 38, and top surface 51 is effectively a continuation of head surface 37. Element 47 extends the entire width of recess 39 and its side surfaces are effective continuations of the head side surfaces at that point.

Element 47 which is of very hard wear resistant metal harder than the metal of head 32, is formed with parallel similarly inclined smooth bores 55 and 56 that align exactly with head bores 45 and 46, and the element is fixed on the head by cylindrical pins 57 and 58 extending through the respective aligned bores. These pins are preferably slightly oversized in diameter with respect to the bores, so that considering inherent resiliency of the pin and or the head metal, a very tight fit is provided. The pins may advantageously be of hollow spring steel construction split longitudinally so as to tend to resiliently expand outwardly when driven into the aligned bores. As shown in FIG. 5, the front and rear ends of the pins are preferably slightly recessed into their bores. The drive fit pins and the interlock between ledge 42 and the bottom of element 47 combine to securely hold element 47 on the head during operation.

Surfaces 48 and 51 of element 47 intersect with an included angle less than 90° and define a cutting edge 59 that lies in the plane containing element surface 48 and head surface 38.

Ring extension 28 is formed with a bore 61 extending between flat parallel end surfaces 62 and 63 that are joined at their inner ends by smoothly curved junctures 64 and 65 to chordal surfaces 66 and 67. The breaker tooth member of FIGS. 3–5 is mounted on the ring as shown with its shank extending through the bore 61 and its head rear surface fully flush with and backed by ring surface 62. Bore 61 is enlarged at 68 where it enters surface 62 to form a socket snugly receiving enlarged portion 35 of shank 33. Tightening of nut 69 on the projecting end of the shank pulls the breaker tooth member into tight assembly with the rotor. It will be noted that at the rear end of the head the bores are so covered by the adjacent abutting ring surface that the pins cannot back out during operation of the machine.

The invention thus provides a breaker tooth member arrangement wherein the hard wear resistant metal edge element is held in interlocked relation with head by tight drive fit pins that do not project to interfere or be broken off during operation. When element 47 is damaged or worn so as to need replacement, this is accomplished by simply taking off nut 69, removing the breaker tooth member from the ring and driving out pins 57 and 58 which can be reused to secure the replacement element. The breaker tooth member on large ring 24 is similar and similarly mounted.

Figure 6:
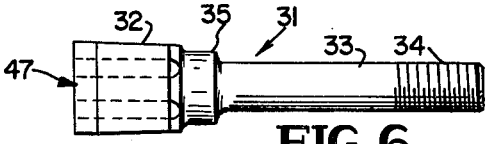
FIG. 6 is a top plan view of another breaker tooth member apart from the rotor.
Figure 7:
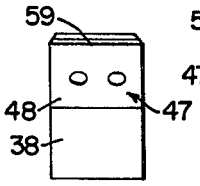
FIG. 7 is a front end view of the breaker tooth member of FIG. 6.
Figure 8:
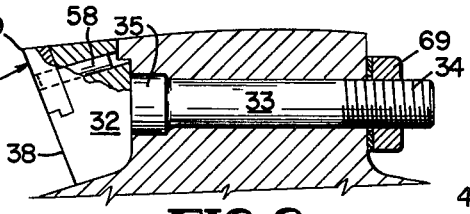
FIG. 8 is a side elevation partly broken away and in section showing the mounting of the working edge element on the head of the breaker tooth member of FIG. 6.

FIGS. 6–8 show another form of breaker tooth member, parts similar to the foregoing embodiment being similarly identified. Here the mounting of wear resistant element 47 is essentially the same as in FIGS. 3–5, but front surface 38 of the head extends further from the ledge.

Figure 9:
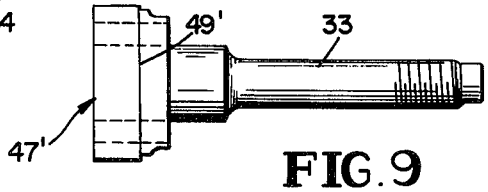
FIG. 9 is a top plan view of a further breaker tooth member apart from the rotor.
Figure 10:
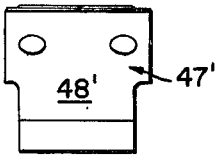
FIG. 10 is a front end view of the breaker tooth member of FIG. 9.
Figure 11:
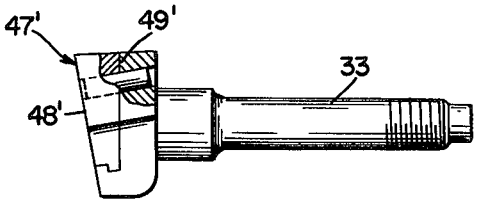
FIG. 11 is a side elevation partly broken away and in section showing the mounting of the working edge element on the head of the breaker tooth member of FIG. 9.

FIGS. 9–11 show another embodiment wherein the element 47′ is larger than in the other embodiments but the essential relationship of parts is maintained. Here hard wear resistant element 47′ has relatively inclined forward and rear surfaces 48′ and 49′ providing more material at the cutting edge, rear surface 49′ and the flush back surface of the recess being here at right angles to the axis of shank 33.

In all of the foregoing embodiments the element 47 is preferably an integral element of a very hard steel alloy very much harder than the steel or other metal that comprises the head of the breaker tooth member.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A breaker tooth member comprising a metal head having an integral rearwardly projecting mounting shank provided with a threaded end, said head being formed opposite said shank with a flat front surface extending at an angle to the axis of said shank, means forming a forwardly open recess at said front surface having a flat back face intersecting a bottom ledge provided all along its forward portion with a lip and having a downwardly displaced region between the lip and said back surface for defining a locking formation, and an integral harder wear resistant metal sharp edged element mounted in said recess flush against said back face, said element being correspondingly formed along its bottom edge to interfit and interlock with said ledge, the front surface of said lip and the forward surface of said element being flat and substantially in the plane of said head front surface, and means for securing said element on the head comprising a plurality of pins having tight friction fit in aligned bores in said head and element.

2. The breaker tooth member defined in claim 1, wherein two of said pins are parallel at opposite sides of the shank axis and extend similarly at an acute angle relative to the shank axis.

3. The breaker tooth member defined in claim 1, in combination with a rotatable support ring therefor having a mounting bore for receiving said shank, said breaker tooth member having an enlarged diameter shank portion adjacent the head and said support ring bore being enlarged in diameter to snugly receive said enlarged shank portion.

4. A breaker tooth as defined in claim 1, wherein said pins are longitudinally split hollow members resiliently stressed in said bores.

* * * * *